US005996989A

United States Patent [19]

Cahill et al.

[11] Patent Number: 5,996,989

[45] Date of Patent: Dec. 7, 1999

[54] SHEET SEPARATOR FRICTION PAD

[75] Inventors: Daniel Paul Cahill, Verona; Edward Alan Rush; Scott Stephen Williams, both of Lexington, all of Ky.

[73] Assignee: Lexmark International, Inc., Lexington, Ky.

[21] Appl. No.: 08/850,897

[22] Filed: May 2, 1997

[51] Int. Cl.[6] ..... B65H 3/52

[52] U.S. Cl. ..... 271/121; 271/119

[58] Field of Search ..... 271/119, 121, 271/124

[56] References Cited

U.S. PATENT DOCUMENTS

| | | | |
|---|---|---|---|
| 4,212,456 | 7/1980 | Ruenzi | 271/4 |
| 4,368,880 | 1/1983 | Shimizu | 271/121 |
| 4,535,981 | 8/1985 | Watanabe et al. | 271/121 |
| 4,588,181 | 5/1986 | Sakata et al. | 271/121 |
| 4,815,724 | 3/1989 | Sumida et al. | 271/121 |
| 4,830,353 | 5/1989 | Hendriks et al. | 271/117 |
| 4,865,306 | 9/1989 | Himegi | 271/121 |
| 5,052,677 | 10/1991 | Shibata | 271/164 |
| 5,056,604 | 10/1991 | Garavuso | 271/113 |
| 5,058,877 | 10/1991 | Fujiwara et al. | 271/124 |
| 5,102,115 | 4/1992 | Takamizawa et al. | 271/121 |
| 5,163,668 | 11/1992 | Winship et al. | 271/121 |
| 5,253,854 | 10/1993 | Tanoue et al. | 271/10 |
| 5,255,903 | 10/1993 | Parsons et al. | 271/124 |
| 5,372,359 | 12/1994 | Miura et al. | 271/119 |
| 5,494,277 | 2/1996 | Flores | 271/251 |
| 5,573,235 | 11/1996 | Asai | 271/121 |
| 5,718,424 | 2/1998 | Nakatani et al. | 271/121 |

FOREIGN PATENT DOCUMENTS

| | | | |
|---|---|---|---|
| 0 466 171 A2 | 1/1992 | European Pat. Off. . | |
| 0 504 833 A1 | 9/1992 | European Pat. Off. . | |
| 2029377 | 3/1980 | United Kingdom | 271/124 |

*Primary Examiner*—Davis A. Bucci
*Assistant Examiner*—Gregory A. Morse
*Attorney, Agent, or Firm*—John A. Brady

[57] ABSTRACT

A sheet feeding apparatus having an edge aligned system always maintains a nip between an intermittently driven pick roll and a friction or separator pad. When a top sheet of a stack is being advanced by the pick roll, a first spring exerts a first force on the friction or separator pad to enable advancement and separation of the top sheet. When the pick roll is stopped, a second spring exerts a second force substantially smaller than the first force on the friction or separator pad but sufficient to maintain the nip between the pick roll and the friction or separator pad to retard.

19 Claims, 10 Drawing Sheets

SHEET SEPARATOR FRICTION PAD

FIELD OF THE INVENTION

This invention relates to a sheet feeding apparatus in which feeding of more than an uppermost sheet of media from a stack of sheets is prevented so that only one sheet is fed to a process station and, more particularly, to a friction pad for exerting different forces on a pick roll of the sheet feeding apparatus depending on the position of the fed sheet along its feed path.

BACKGROUND OF THE INVENTION

Friction separator paper pick mechanisms are commonly used in printers and copiers, for example, to feed a single sheet of paper into transport rolls, which forward the single sheet to a process station of the printer or copier. A typical friction separator paper pick mechanism includes a spring loaded paper-lift plate, a high friction pick roll, and a spring loaded separator pad.

The separator pad is formed of a material having a coefficient of friction with paper greater than the coefficient of friction between adjacent sheets of paper but smaller than the coefficient of friction between the pick roll and a sheet of paper. This relationship of the coefficients of friction insures that the pad will not prevent advancement of the sheet by the pick roll but will separate any sheet beneath the uppermost sheet. The geometry of the mechanism has both the paper-lift plate and the separator pad contact the high friction pick roll with the uppermost sheet in the paper-lift plate contacting the high friction pick roll prior to the sheet being fed between the separator pad and the high friction pick roll.

When actuated to advance a sheet of paper from a stack, the paper-lift plate moves to a position in which the uppermost sheet in the stack is engaged by the intermittently driven pick roll so that the uppermost sheet is fed into a nip formed between the pick roll and the separator pad. If only a single sheet is picked by the pick roll, the fed sheet will pass through the nip formed between the pick roll and the separator pad into the printer or copier because of the high coefficient of friction between the pick roll and the sheet in comparison with the coefficient of friction between the separator pad and the sheet. If two or more sheets are picked by the pick roll as occurs with many high friction media, the purpose of the separator pad is to restrain all but the uppermost sheet in the stack from being advanced during a specific cycle of operation.

After the sheet is fed to the transport rolls for advancement into the printer or copier, it is critical to minimize drag on the fed sheet in an edge aligned printer or copier. This is because one of the sheet's side edges rides along guide means as the sheet is transported by relatively small rollers and relatively low nip forces.

In an edge aligned system, extraneous drag on the sheet can cause skew of print and other imaging degradation. In severe cases, the extraneous drag on the sheet can cause the sheet to slip in the transport rolls whereby the sheet jams in its feed path through the printer or copier.

Since the drag must be minimized in an edge aligned system, the spring load between the sheet and the pick roll is normally removed after the sheet is picked from the stack by the pick roll to open the nip. This is accomplished by either moving the paper-lift plate away from the pick roll or raising the pick roll away from the stack of sheets. The spring load between the separator pad and the pick roll also is removed to prevent the unwanted drag.

This opening of the two nips is the principal contributor to feeding more than one sheet during a cycle of operation in this type of mechanism. This is because opening of the two nips enables one or more of the underlying sheets in the stack to be dragged into the printer along with the uppermost sheet unless the motion of the underlying sheets is retarded in some manner.

Retarding of the motion of the underlying sheets is usually accomplished by rotating an arm having sharp steps, which catch the underlying sheets, into the sheet feed path by the same mechanism, which drops the separator pad from engagement with the pick roll. In this arrangement, the timing, geometry, and tolerances are very critical since the retarding means must be disposed to catch the underlying sheets as the nip is opened or multiple sheets will be fed. Even when the retarding means is disposed in its proper position, media of high friction and low weight in particular still tend to be dragged into the printer or copier by the fed sheet through "jumping" over the retarding means.

This problem is averted in a center driven system by having the spring loaded paper-lift plate and the spring loaded separator pad remain in contact with the high friction pick roll throughout the feeding of the entire stack. This is possible because it is not necessary to open the nips after feeding of each sheet since center driven sheet feeders for printers and copiers have much larger transport rolls, much higher nip forces, and no reference edge with which the sheet must be aligned. Of course, this is a more costly system in comparison with the edge aligned system having the relatively smaller rollers.

The much larger transport rolls of the center driven system can exert a sufficient force to pull each sheet from the nips without having to open either of the two nips. The pick roll is usually driven through a one-way clutch to aid the transport rolls in moving the sheet.

Since the two nips are not opened and closed for each fed sheet in the center driven system, the timing, geometry, and tolerances are not as critical in terms of feed reliability as in the edge aligned system. This is because the sheets are always tightly held in the nips so that there is less chance of the underlying sheets being dragged into the printer or copier along with the uppermost sheet. However, as previously mentioned, the center driven system requires a higher cost for its parts in comparison with the edge aligned system, and it also requires more power to operate.

SUMMARY OF THE INVENTION

The sheet feeding apparatus of the present invention overcomes the foregoing problems of the edge aligned system through always maintaining a nip between the pick roll and the friction or separator pad. In the present invention, the friction or separator pad always exerts a force on the pick roll to maintain the nip. A first force is exerted on the friction or separator pad, preferably through first resilient means, when a sheet is being advanced by the pick roll. A second force, smaller than the first force, is exerted on the friction or separator pad, preferably through second resilient means, when the pick roll is no longer being driven.

The friction or separator pad is preferably pivotally supported by a pivotally mounted separator arm or carrier. When a sheet is being fed by the pick roll, the pad is at a first angle to the pick roll and subjected to the first force. When the pick roll is stopped, the pad is at a second angle, greater than the first angle, to the pick roll to provide a greater obstacle to any underlying sheet trying to pass over it and subjected to the second force.

An object of this invention is to provide a separator pad exerting two different forces on a pick roll in accordance with the position of the fed sheet.

Another object of this invention is to improve the feed reliability of an edge aligned system.

A further object of this invention is to maintain a nip between a friction pad and a pick roll after a pick-up lift plate ceases to be in a position in which it holds the uppermost sheet in a stack against the pick roll.

Other objects of this invention will be readily perceived from the following description, claims, and drawings.

BRIEF DESCRIPTION OF THE DRAWINGS

The attached drawings illustrate a preferred embodiment of the invention, in which.

DETAILED DESCRIPTION OF PREFERRED EMBODIMENT

Figure 1:
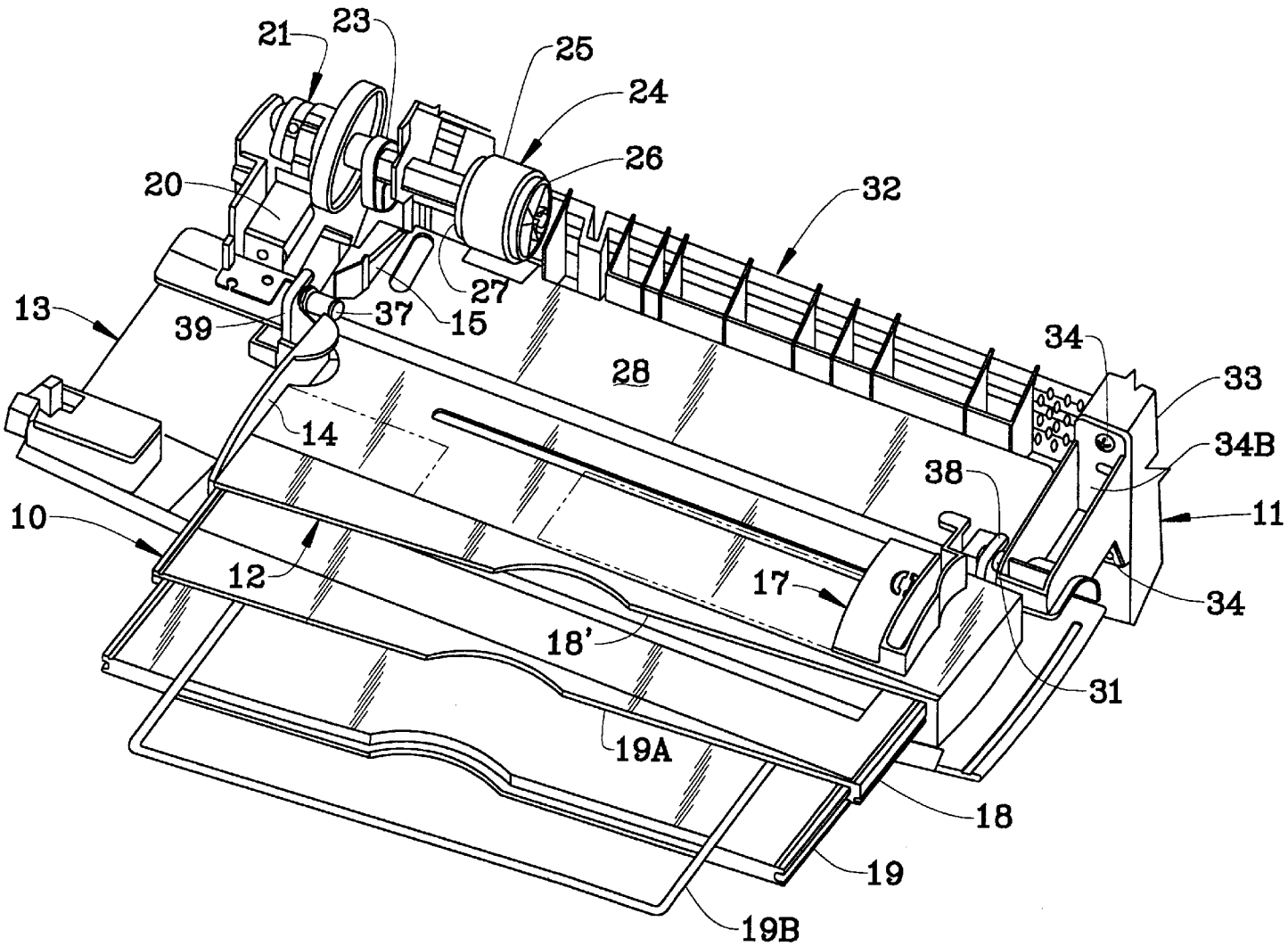
FIG. 1 is a perspective view of a portion of a sheet feed apparatus of a printer with the sheet feed apparatus having a friction or separator pad of the present invention.

Referring to the drawings and particularly FIG. 1, there is shown a sheet feed apparatus 10 of a printer 11. The sheet feed apparatus 10 includes a tray assembly 12, which is mounted on a pivotally mounted door 13 of the printer 11.

The tray assembly 12 has reference edges 14 and 15 against which the left side edge of each sheet 16 (see FIG. 3) of a media such as paper, for example, abuts during its advancement. A movable paper guide 17 (see FIG. 1) engages the right edge of each of the sheets 16 (see FIG. 3) when they are disposed in a stack in the tray assembly 12 (see FIG. 1). Thus, the sheet feed apparatus 10 uses an edge aligned system for guiding the sheets 16 (see FIG. 3) of the stack to the printer 11 (see FIG. 1).

The tray assembly 12 includes a first slide 18 slidable within an opening 18' and a second slide 19 slidable within an opening 19A in the first slide 18. A metal wire 19B is attached to the second slide 19 to pull it from the first slide 18 until a stop (not shown) in the second slide 19 engages a stop (not shown) on the first slide 18. The same arrangement exists between the first slide 18 and the interior of the tray assembly 12.

Advancement of the uppermost sheet 16 (see FIG. 3) of the stack is accomplished whenever a solenoid 20 (see FIG. 1) is energized by a signal from a printer or copier (not shown), for example, that one of the sheets 16 (see FIG. 3) is to be advanced to the printer 11 (see FIG. 1) for printing. The solenoid 20 activates a pick clutch assembly 21 to cause a shaft 22 (see FIG. 2) to be rotated through a cycle of operation by a motor (not shown). The shaft 22 has a cam 23 and a pick roll 24 affixed thereto for rotation therewith.

The pick roll 24 includes a central portion 25 of rubber having a constant radius. End portions 26 and 27 (see FIG. 1) of the pick roll 24 are formed of acetal, which has a very low coefficient of friction with paper. The periphery of each of the end portions 26 and 27 is eccentric to the central portion 25.

When the shaft 22 is rotated, the rubber portion 25 of the pick roll 24 is rotated into the engagement with the uppermost sheet of the sheets 16 (see FIG. 3) in the stack resting on a metal lift plate 28 (see FIG. 1). When the rubber portion 25 of the pick roll 24 engages the uppermost sheet 16 (see FIG. 3), the sheet 16 is advanced from the stack, which is supported by the lift plate 28 (see FIG. 1).

Figure 2:
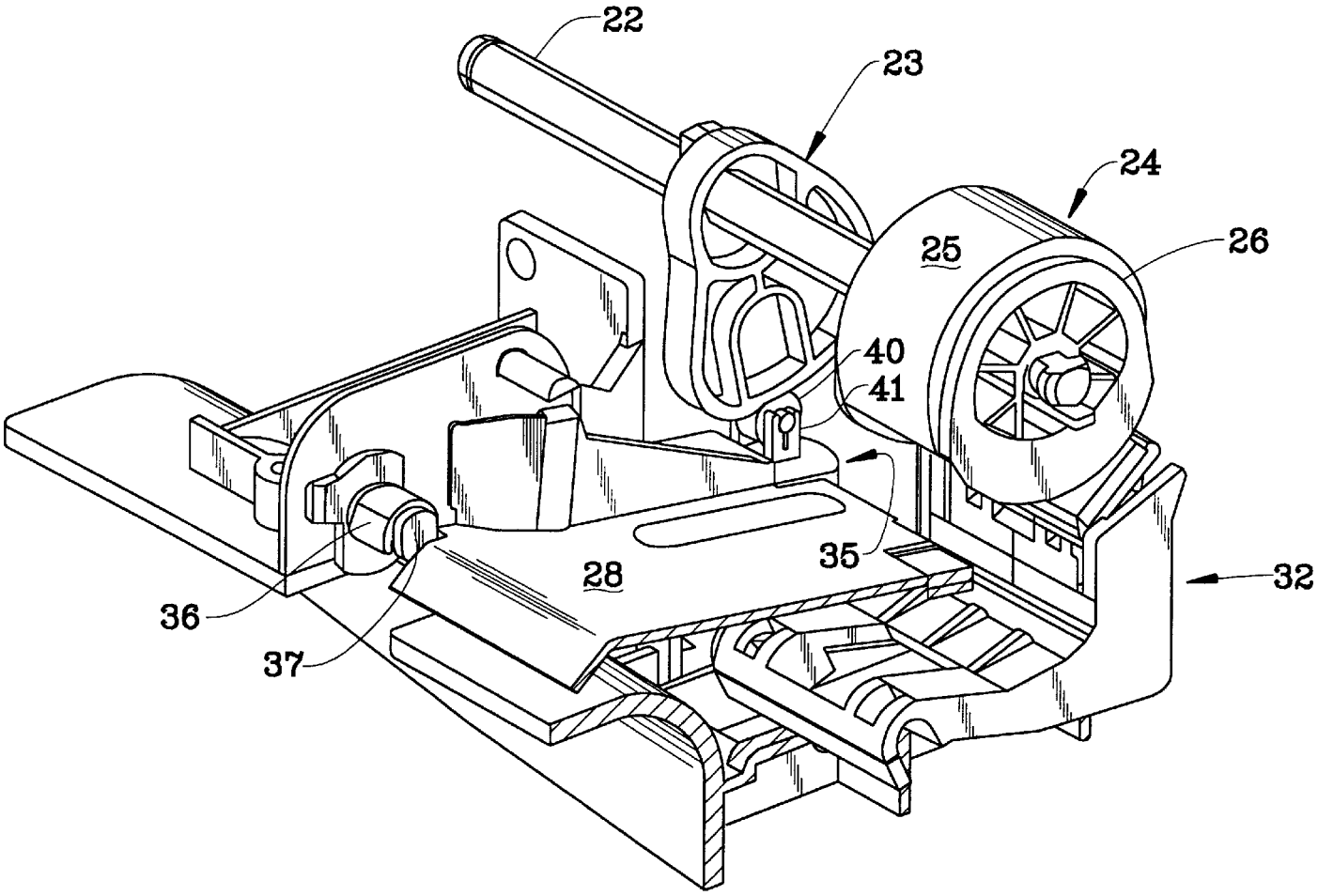
FIG. 2 is a perspective view, partly in section, of a portion of the sheet feed apparatus of FIG. 1 and taken from the side of FIG. 1 with a pick roll of the sheet feed apparatus in its home position.
Figure 4:
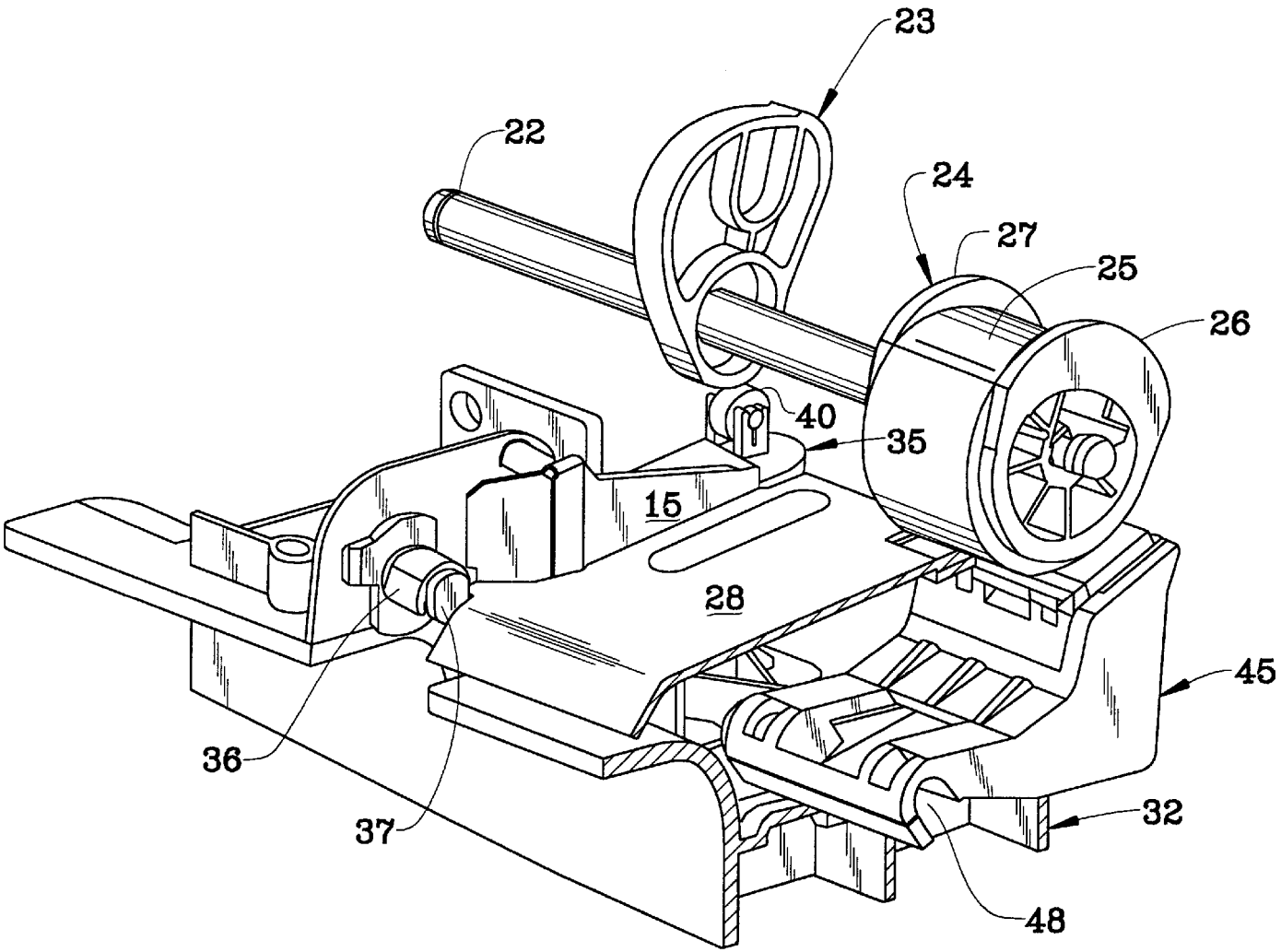
FIG. 4 is a perspective view, partly in section, of a portion of the sheet feed apparatus of FIG. 1 and showing the pick roll of the sheet feed apparatus in its pick position.
Figure 11:
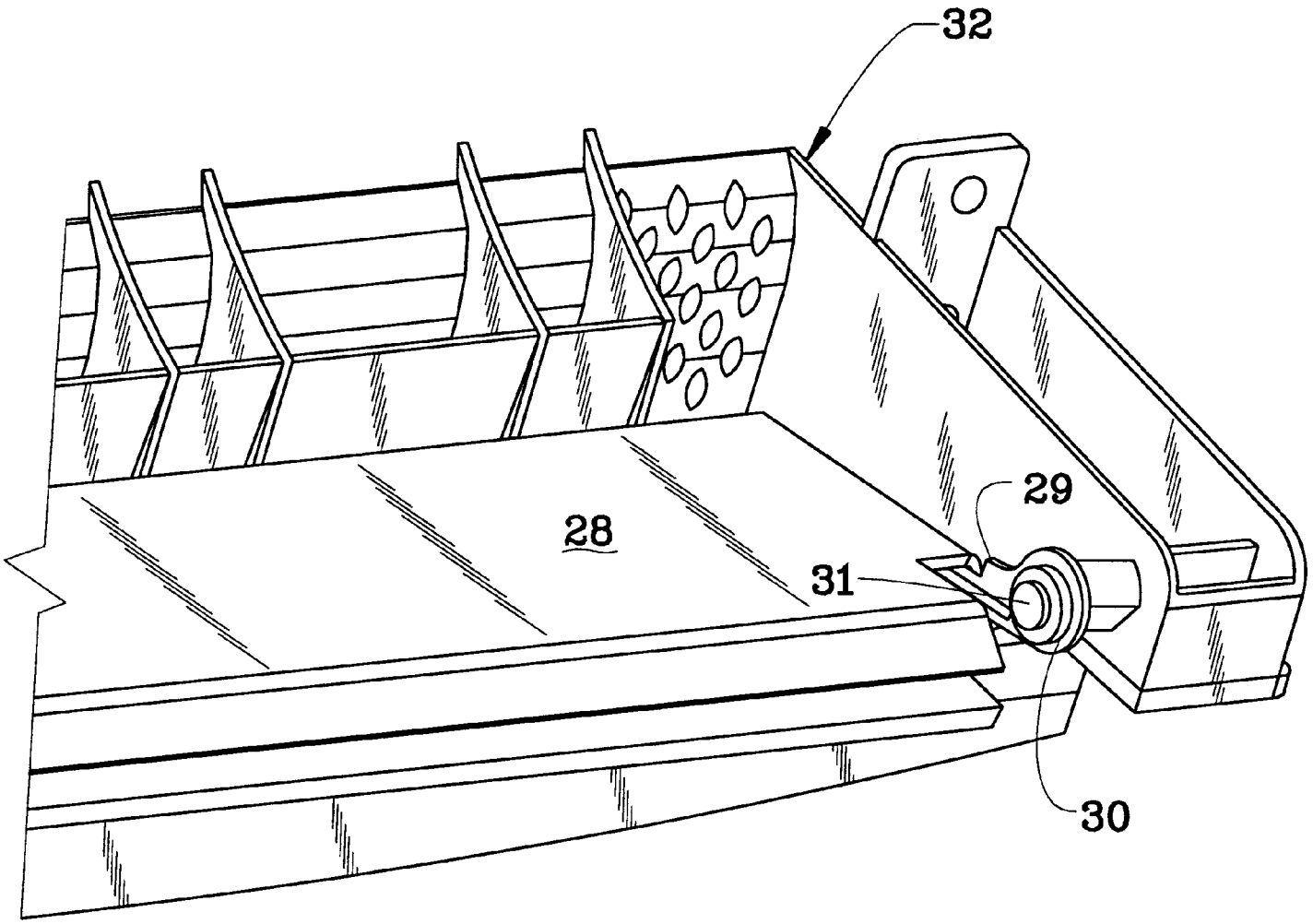
FIG. 11 is an enlarged perspective view of a portion of the sheet feed apparatus of FIG. 1 showing the pivotal mounting of one side of the lift plate on the deflector assembly.

The lift plate 28 is pivotally mounted for movement between the position of FIG. 2, which is the home position of the pick roll 24, and the position of FIG. 4, which is the pick position of the pick roll 24 in which the uppermost sheet 16 (see FIG. 5) is engaged by the pick roll 24 for advancement from the stack of the sheets 16. One end of the lift plate 28 has a portion 29 (see FIG. 11) bent at a right angle thereto with an opening 30 to fit over a post 31. The post 31 is a portion of a deflector assembly 32, which is formed of molded plastic.

One side of the deflector assembly 32 is secured to a side frame 33 (see FIG. 1) of the printer 11 by screws 34 passing through a pair of openings 34A (see FIG. 8) in a flat vertical portion 34B of the deflector assembly 32. The deflector assembly 32 has its other side similarly secured to another side frame (not shown) of the printer 11 (see FIG. 1) through openings 34C (see FIG. 9) in a flat vertical portion 34D.

The other side of the lift plate 28 (see FIG. 4) has an end cap 35, which is formed of molded plastic, affixed thereto. The end cap 35 has a bearing portion 36 to receive a post 37 of the deflector assembly 32. The post 37 is aligned with the post 31 (see FIG. 11).

The door 13 (see FIG. 1) is pivotally supported by the deflector assembly 32. The door 13 pivots about an axis aligned with the posts 31 (see FIG. 11) and 37 (see FIG. 2), which form the pivot axis of the lift plate 28. Thus, the door 13 (see FIG. 1) has a portion 38 pivotally mounted on the post 31 (see FIG. 11) and a portion 39 (see FIG. 1) pivotally mounted on the post 37.

In the home position, the lift plate 28 (see FIG. 2) is held in its lowermost position through the cam 23 engaging a cam follower 40, which is a roller, rotatably supported by a pair of upstanding ears 41 on the end cap 35. The cam follower 40 is held against the cam 23 by a spring 42 (see FIG. 9), which has its upper end bearing against the bottom surface of the end cap 35 and its lower end engaging a flat surface 43 of the deflector assembly 32.

Figure 7:
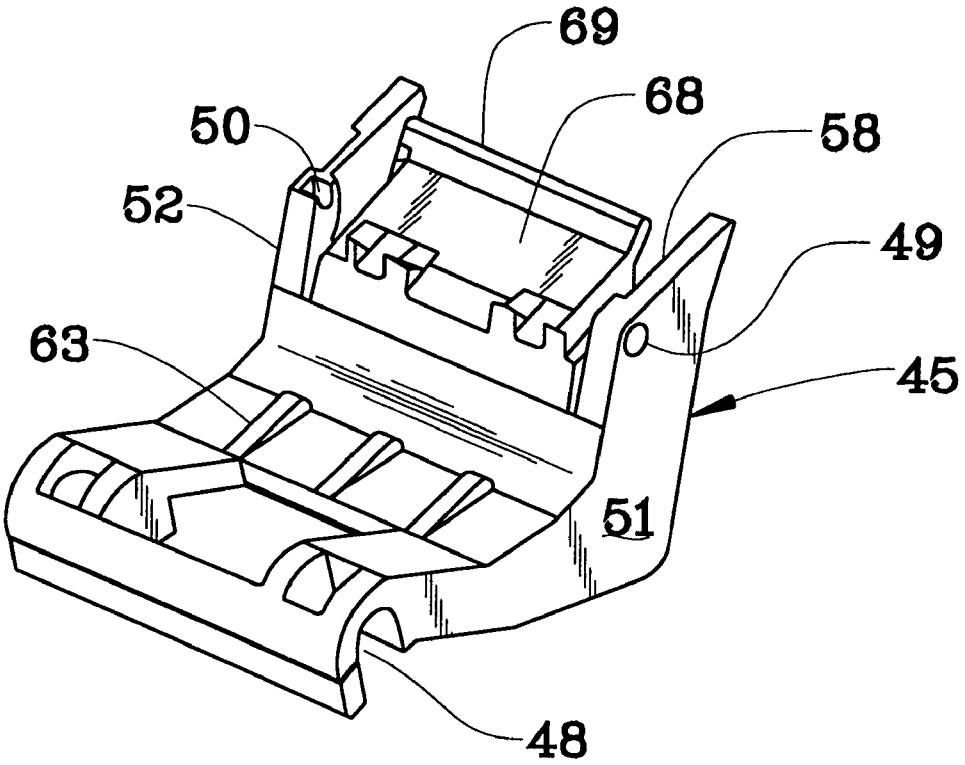
FIG. 7 is an enlarged perspective view of a separator arm or carrier for pivotally supporting the separator pad assembly of FIG. 6.
Figure 8:
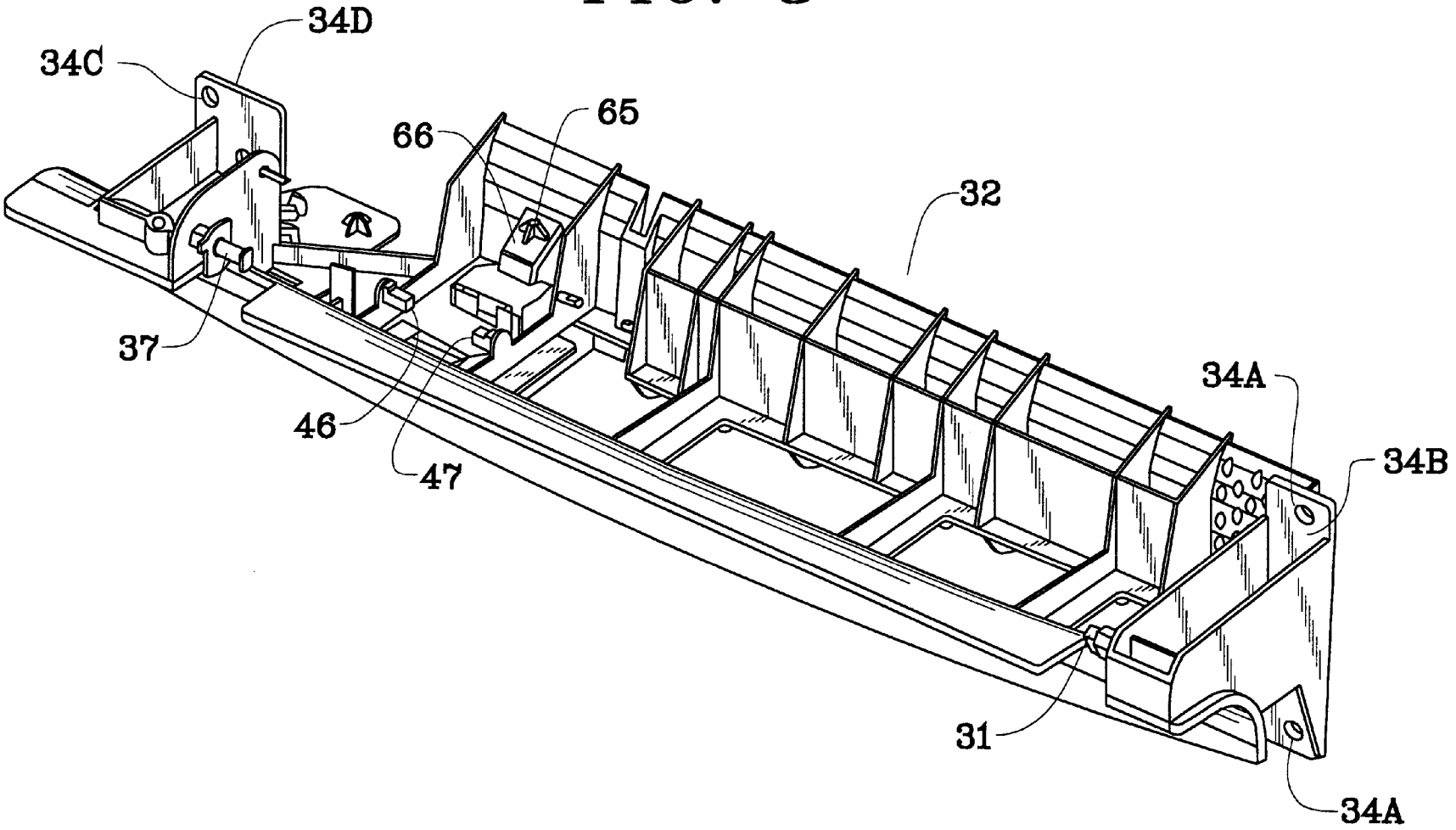
FIG. 8 is a perspective view of a deflector assembly pivotally supporting the separator arm and the separator pad.
Figure 9:
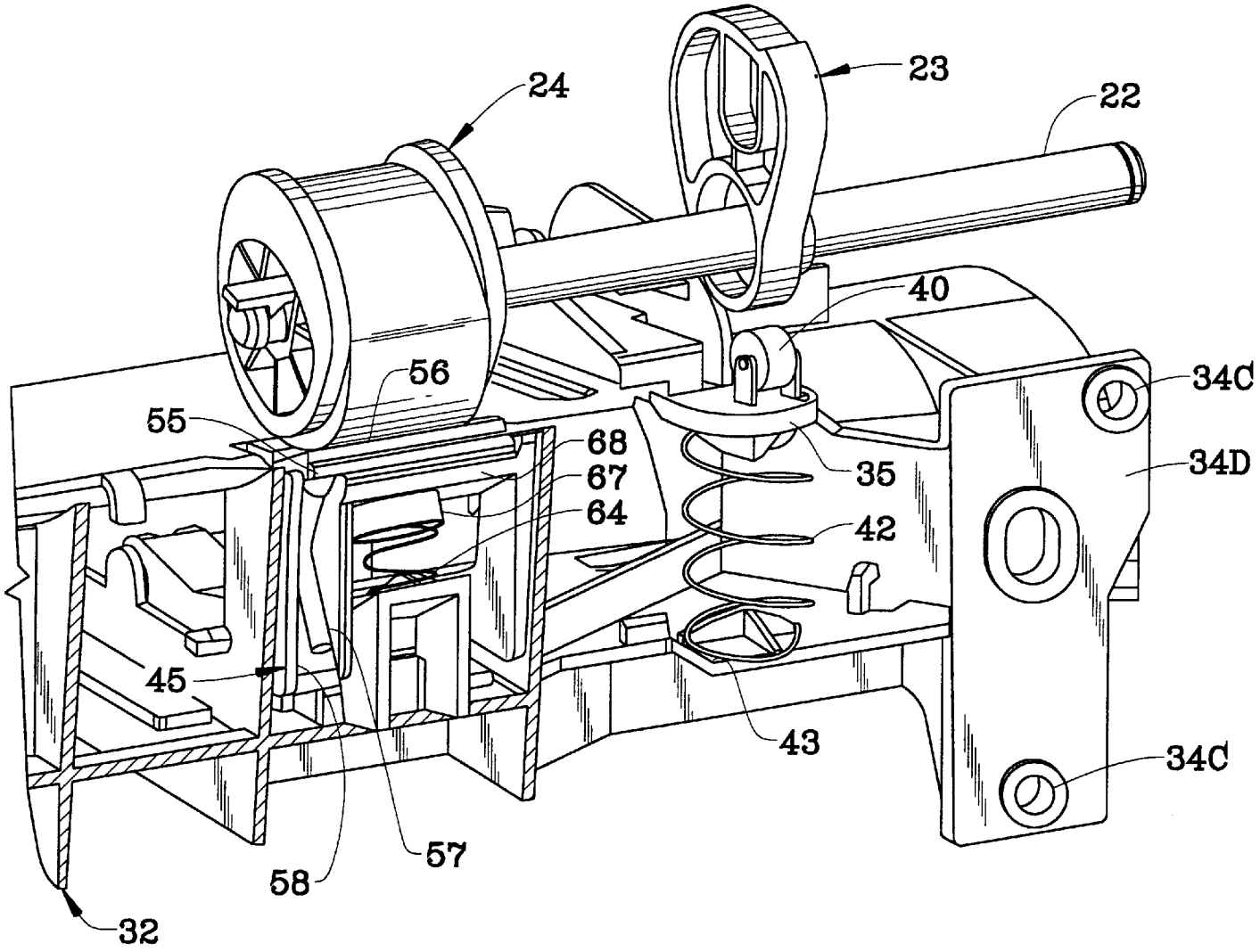
FIG. 9 is a rear elevational view, partly in section, of a portion of the sheet feed apparatus of FIG. 1 with the pick roll of the sheet feed apparatus in its pick position and showing the two springs that provide the two forces on the friction or separator pad.

A pivotally mounted separator arm or carrier 45 (see FIG. 7) is pivotally mounted on the deflector assembly 32 (see FIG. 8). The deflector assembly 32 has a pair of aligned studs 46 and 47 for disposition within arcuate portions 48 (see FIG. 7) on opposite sides of the lower end of the separator arm 45.

Figure 6:
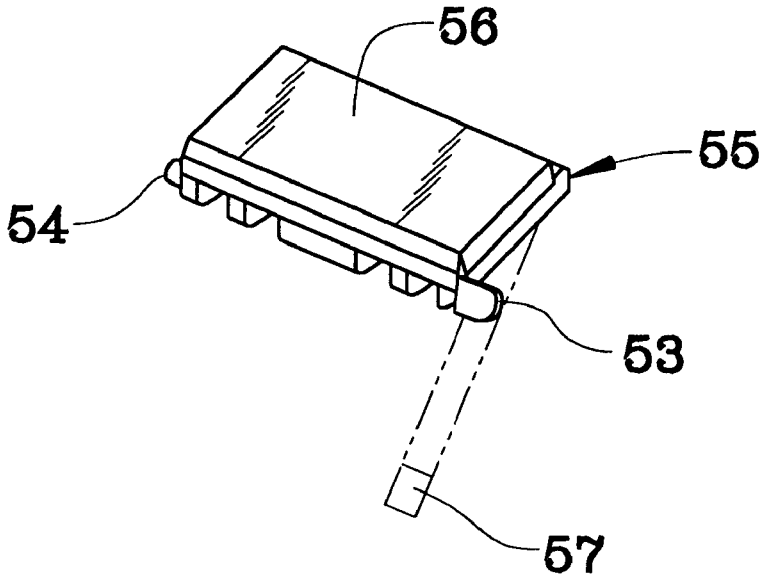
FIG. 6 is an enlarged perspective view of a separator pad assembly.

The separator arm or carrier 45 has a pair of aligned bearing support areas 49 and 50 in its side walls 51 and 52, respectively. The bearing support areas 49 and 50 receive pivot pins 53 (see FIG. 6) and 54, respectively, extending from opposite sides of a pad housing 55 to pivotally support the pad housing 55 on the separator arm 45 (see FIG. 7).

The pad housing 55 (see FIG. 6) has a separator pad 56 fixed thereto, preferably by a suitable adhesive. The separator pad 56 is formed of a material having a greater coefficient of friction with respect to each of the sheets 16 (see FIG. 3) of paper than the coefficient of friction between two of the adjacent sheets 16. However, the coefficient of friction of the material of the separator pad 56 (see FIG. 6) with each of the sheets 16 (see FIG. 3) of paper is less than the coefficient of friction between the rubber portion 25 of the pick roll 24 and each of the sheets 16 of paper.

One suitable example of the material of the separator pad 56 (see FIG. 6) is a polymer sold by Dow Chemical Company under the trademark PELLETHANE as Series 2355-75. To obtain a desired coefficient of friction of 1.0 against 20 pound xerographic paper, the top surface of the polymer is ground to remove the mold skin.

When the sheet feed apparatus 10 (see FIG. 3) is in its home position, the friction or separator pad 56 is engaged by the end portions 26 and 27 of the pick roll 24 extending beyond the rubber portion 25. The force of a buckling spring 57 holds the separator pad 56 against the pick roll 24.

The buckling spring 57 has its upper end mounted on a downwardly extending post 57' on the pad housing 55 and its lower end disposed within an inclined track 58 in the separator arm 45. The buckling spring 57 exerts a relatively light force of about 20 grams on the bottom of the pad housing 55.

Figure 3:
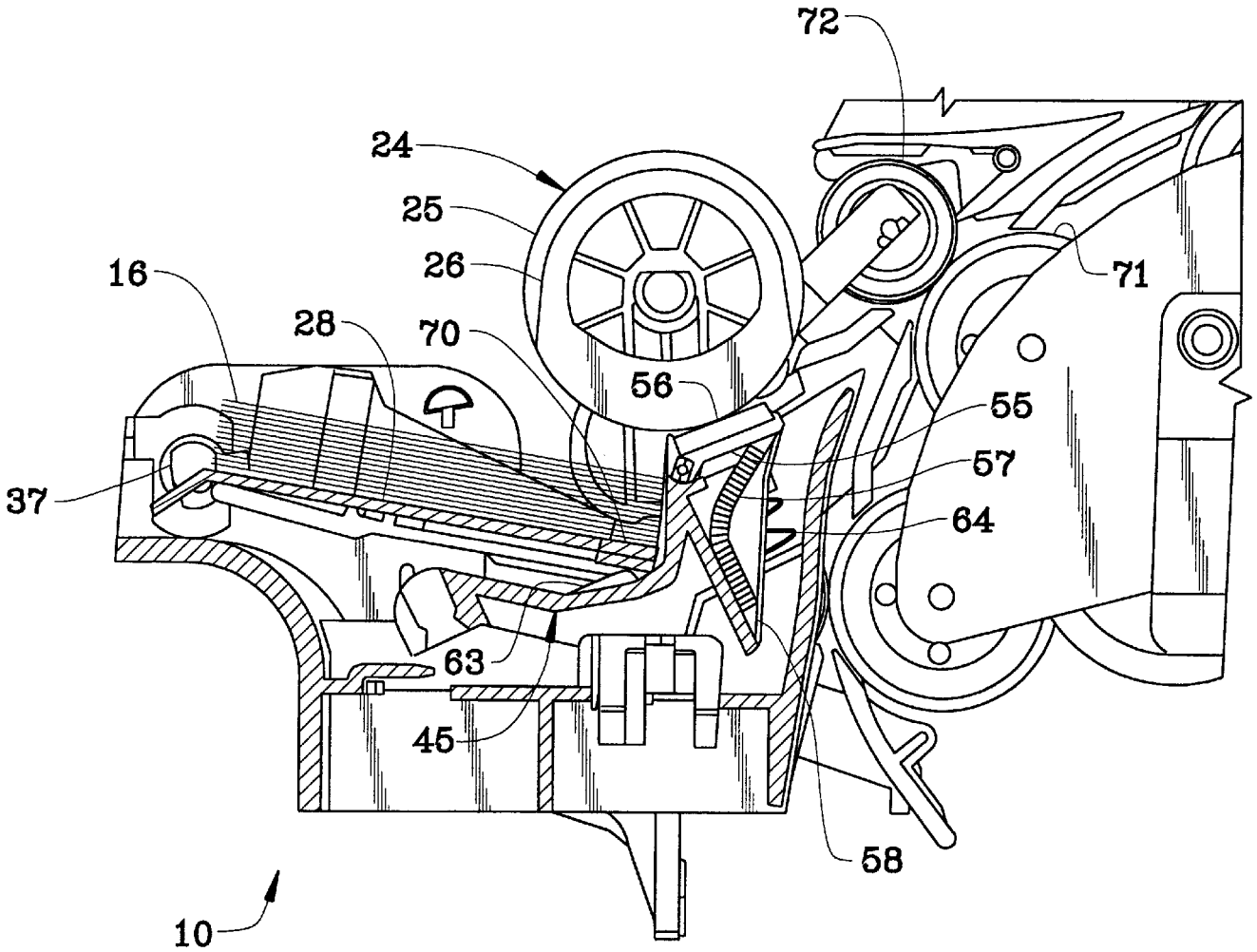
FIG. 3 is a side elevational view, partly in section, of a portion of the sheet feed apparatus of FIG. 1 with the pick roll of the sheet feed apparatus in its home position and showing a plurality of sheets in a stack on a lift plate.
Figure 5:
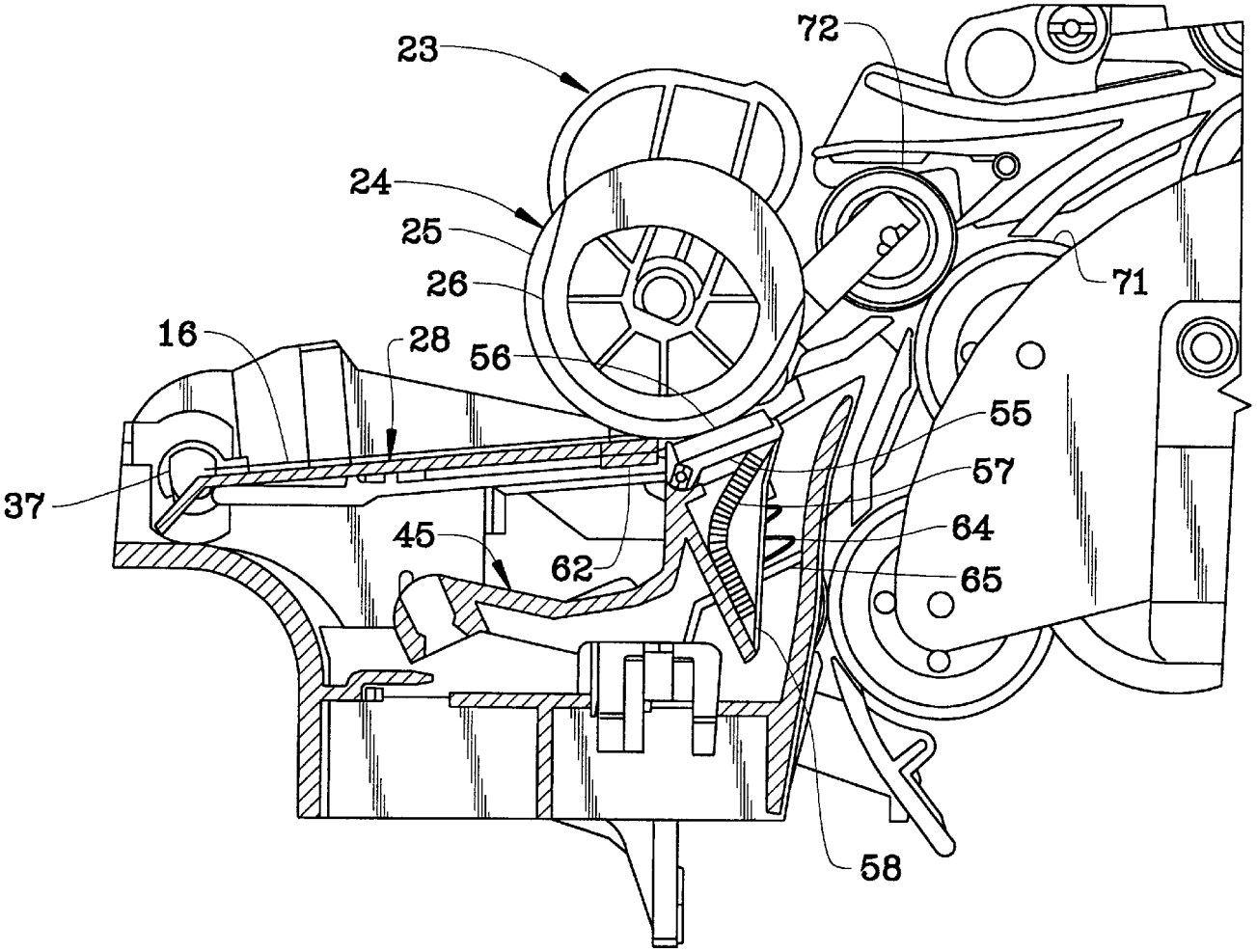
FIG. 5 is a side elevational view, partly in section, of a portion of the sheet feed apparatus of FIG. 1 with the pick roll of the sheet feed apparatus in its pick position and showing only a single sheet in the lift plate.

As the cam 23 (see FIG. 5) rotates during a cycle of operation, the spring 42 (see FIG. 9) continues to act on the end cap 35 to pivot the lift plate 28 about the posts 31 (see FIG. 8) and 37 upwardly from the home position of FIG. 3 to the pick position of FIG. 5. In the pick position of FIG. 4, the cam follower 40 does not engage the cam 23 but is slightly spaced therefrom. The upward pivotal motion of the lift plate 28 by the spring 42 (see FIG. 9) ceases when the top sheet 16 (see FIG. 5) of the stack on the lift plate 28 engages the pick roll 24.

When the cam 23 has been rotated to the pick position of FIG. 4, the pick roll 24 has been rotated to the position in which the rubber portion 25 engages and advances the uppermost sheet 16 (see FIG. 3) in the stack on the lift plate 28. In its uppermost position, the lift plate 28 is disposed, as shown in FIG. 5, so that the rubber portion 25 of the pick roll 24 engages the uppermost sheet of the sheets 16 supported by the lift plate 28. The position of the lift plate 28 in FIG. 5 is when only one of the sheets 16 is remaining on the lift plate 28. It should be understood that the final position of the lift plate 28 depends upon the number of the sheets 16 remaining on the lift plate 28.

In the home position of FIG. 3 in which the lift plate 28 is at its lowermost position and has a plurality of the sheets 16 thereon, a depressed portion 62 of the lift plate 28 engages a plurality of ribs 63 on the separator arm or carrier 45. This pivots the separator arm 45 to prevent a spring 64 from exerting a force on the separator pad 56.

One end of the spring 64 fits around a projecting portion 65 (see FIG. 8) on an inclined surface 66 of the deflector assembly 32. The other end of the spring 64 (see FIG. 9) fits within a hollow cylinder 67 on the bottom of a portion 68 (see FIG. 7) of the separator arm 45.

Figure 10:
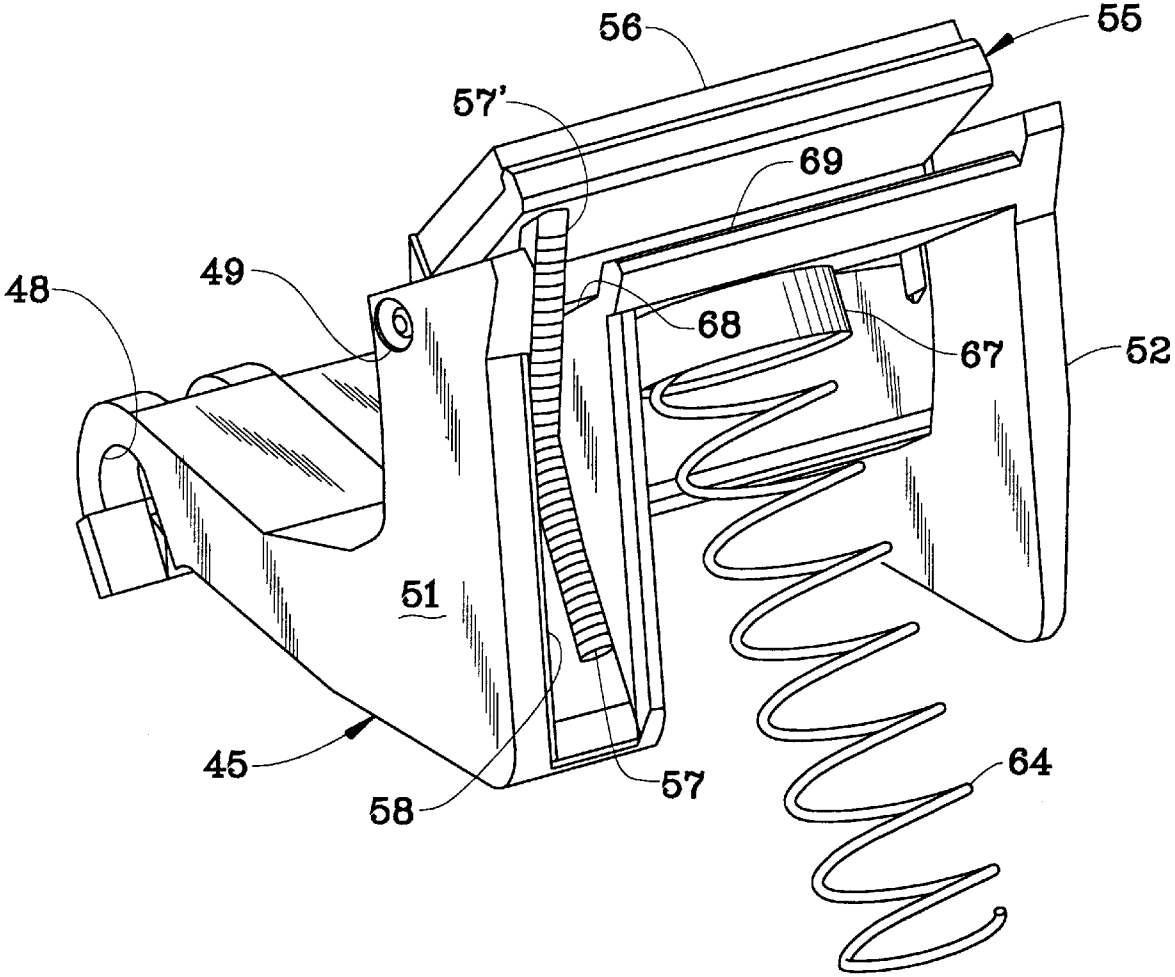
FIG. 10 is a rear elevational view of the separator pad assembly of FIG. 6 assembled on the separator arm or carrier of FIG. 7 with the pick roll of the sheet feed apparatus in its home position and showing the two springs that provide the two forces on the friction or separator pad with the friction or separator pad at its maximum angle.

Thus, the spring 64 (see FIG. 3), which produces a force of about 250 grams on the separator pad 56, is not applied against the pick roll 24 when the pick roll 24 and the lift plate 28 are in the home position. As a result, only the small force of the buckling spring 57 is acting against the end portions 26 and 27 (see FIG. 4) of the pick roll 24 (see FIG. 3) to move the separator pad 56 to the elevated position of FIG. 10. Because of the higher angle of the separator pad 56 relative to the axis of the pick roll 24, the separator pad 56 is more effective in preventing the advancement of the underlying sheets 16.

This arrangement insures that the nip between the pick roll 24 (see FIG. 3) and the separator pad 56 is always blocked. Of course, there is a very low coefficient of friction acting on the moving sheet 16 of paper because the separator pad 56 is forcing the sheet 16 to bear against the end portions 26 and 27 (see FIG. 4) of the pick roll 24 (see FIG. 3) rather than the rubber portion 25.

While the coefficient of friction of the separator pad 56 with the sheets 16 is greater than the coefficient of friction between two of the sheets 16 so that this will prevent more than one of the sheets 16 from passing through the nip, the low force produced by the buckling spring 57 is not sufficient to enable advancement and separation of the uppermost sheet of the sheets 16 from the stack when the pick roll 24 is in its pick position of FIG. 5. When the pick roll 24 is in its pick position, the spring 64 exerts a force through the portion 68 (see FIG. 7) of the separator arm 45. This is because pivoting of the lift plate 28 (see FIG. 5) to its upper position has allowed the separator arm 45 to pivot to a position in which a raised end 69 (see FIG. 7) of the portion 68 of the separator arm 45 is engaging the pad housing 55 (see FIG. 5) so that the force of the spring 64 is exerted through the friction or separator pad 56 to insure that the uppermost of the sheets 16 is held against the rubber portion 25 of the pick roll 24 with a sufficient force to enable advancement and separation of the uppermost sheet 16.

Accordingly, sufficient force is applied by the spring 64 (see FIG. 5) to insure advancement and separation of the uppermost sheet 16 from the stack by the pick roll 24. At the same time, when the pick roll 24 is in the home position of FIG. 3, only the force of the buckling spring 57 is effective. However, this relatively small force of about 20 grams is sufficient to prevent opening of the nip between the pick roll 24 and the separator pad 56 at any time.

The lift plate 28 has a restraint pad 70 disposed on top of the depressed portion 62. The restraint pad 70 prevents shifting of the stack of the sheets 16 through restraining the bottom sheet 16 of the stack.

One suitable example of the material of the restraint pad 70 is a cellular urethane sold under the trademark PORON as Part No. 4701-05-30-062-1637 by Rogers Corporation, Rogers, Conn. To obtain the desired coefficient of friction against paper, one surface is ground to remove the mold skin to provide the correct coefficient of friction against the sheet 16 (see FIG. 5) of paper.

After the sheet 16 of paper is advanced past the separator pad 56, it advances between a driver transport roll 71 and a driven transport roll 72. The rolls 71 and 72 advance the sheet 16 of paper to a process station at the printer 11 (see FIG. 1).

While the sheet feed apparatus 10 has been shown and described as being used with the printer 11, it should be understood that the sheet feed apparatus 10 may be used with any apparatus feeding a sheet from a stack to a process station, for example, in which only one sheet is to be fed from the stack to the processing station.

An advantage of this invention is that the adverse effects of skew and other print degradation in an edge aligned system are significantly reduced. Another advantage of this invention is that it decreases picking of multiple sheets from a stack of sheets in an edge aligned system.

For purposes of exemplification, a particular embodiment of the invention has been shown and described according to the best present understanding thereof. However, it will be apparent that changes and modifications in the arrangement and construction of the parts thereof may be resorted to without departing from the spirit and scope of the invention.

What is claimed is:

1. A sheet feeding apparatus for feeding a single sheet from a stack of sheets including:

support means for supporting a plurality of sheets in a stack;

an intermittently driven pick roll for engaging the uppermost of the sheets in the stack to advance the uppermost sheet from the stack;

said support means being mounted to move said sheets to contact said pick roll;

a friction pad movably mounted on a carrier movable with the movement of said support means disposed downstream from engagement of said pick roll with the uppermost sheet of the stack of sheets supported by said support means, said friction pad always exerting a force on said pick roll;

first causing means for causing said friction pad to exert a first force on said pick roll when said pick roll is driven and engages the uppermost sheet of the stack of sheets on said support means to remove the sheet therefrom while the uppermost sheet is still supported by said support means; and second causing means for causing said friction pad to exert a second force smaller than the first force on said pick roll when relative movement occurs between said pick roll and said support means so that the uppermost sheet of the stack of sheets is held between said pick roll and said friction pad.

2. The apparatus according to claim 1 including pivotal mounting means for pivotally mounting said friction pad to change the angle of said friction pad relative to the axis of rotation of said pick roll in accordance with whether said support means is disposed in a first position so that the uppermost sheet of the stack of sheets supported by said support means is engaged by said pick roll or in a second position in which the uppermost sheet of the stack of sheets is held between said pick roll and said friction pad.

3. The apparatus according to claim 2 in which said pivotal mounting means includes:

a pivotally mounted carrier;

said pivotally mounted carrier having said friction pad pivotally supported thereon;

said first causing means acting on said pivotally mounted carrier to cause pivoting of said pivotally mounted carrier so that said friction pad exerts the first force on said pick roll;

and said second causing means causing said friction pad to pivot relative to said pivotally mounted carrier so that said friction pad exerts the second force on said pick roll when said first causing means is not effective.

4. The apparatus according to claim 3 in which said support means engages said pivotally mounted carrier to render said pivotally mounted carrier ineffective when said support means is not in its first position in which the uppermost sheet may be removed from said support means by said pick roll.

5. The apparatus according to claim 4 in which said first causing means includes first resilient means acting on said pivotally mounted carrier.

6. The apparatus according to claim 3 in which said support means includes a pivotally mounted lift plate engaging said pivotally mounted carrier.

7. The apparatus according to claim 6 in which said first causing means includes first resilient means acting on said pivotally mounted carrier.

8. The apparatus according to claim 3 including:

a pad housing having said friction pad fixed thereto;

pivotal mounting means for pivotally mounting said pad housing on said pivotally mounted carrier to pivotally support said pad housing on said pivotally mounted carrier for pivotal movement relative to said pivotally mounted carrier.

9. The apparatus according to claim 8 in which said second causing means includes resilient means acting between said pad housing and said pivotally mounted carrier to exert the second force on said pad housing for transmission to said pick roll.

10. The apparatus according to claim 9 in which said second causing means includes resilient means acting on said friction pad.

11. The apparatus according to claim 3 in which said first causing means includes first resilient means acting on said pivotally mounted carrier.

12. The apparatus according to claim 11 in which said second causing means includes second resilient means acting on said friction pad.

13. The apparatus according to claim 3 in which said second causing means is effective when said support means moves to its second position so that said friction pad pivots relative to said pivotally mounted carrier to exert the second force on said pick roll.

14. The apparatus according to claim 13 in which said second causing means includes resilient means acting on said friction pad.

15. The apparatus according to claim 3 in which said first causing means includes first resilient means acting on said friction pad.

16. The apparatus according to claim 15 in which said second causing means includes second resilient means acting on said friction pad.

17. The apparatus according to claim 3 in which said second causing means includes resilient means acting on said friction pad.

18. The apparatus according to claim 1 including guide means for engaging a side edge of each sheet to guide each sheet during its advancement by said pick roll.

19. A sheet feeding apparatus for feeding a single sheet from a stack of sheets including:

support means for supporting a plurality of sheets in a stack;

an intermittently driven pick roll for engaging the uppermost of the sheets in the stack to advance the uppermost sheet from the stack;

said support means being mounted to move said sheets to contact said pick roll;

a friction pad movably mounted by resilient means having a first force disposed downstream from the engagement of said pick roll with the uppermost sheet of the stack of sheets supported by said support means, said friction pad always exerting a force on said pick roll;

first causing means for causing said friction pad to exert a second first force on said pick roll when said pick roll is driven and engages the uppermost sheet of the stack of sheets on said support means to remove the sheet therefrom while the uppermost sheet is still supported by said support means, said second force being larger than said first force; and second causing means for causing said friction pad to be urged toward said pick roll by said resilient means with said first force when relative movement occurs between said pick roll and said support means so that the uppermost sheet of the stack of sheets is held between said pick roll and said friction pad.

* * * * *

UNITED STATES PATENT AND TRADEMARK OFFICE

CERTIFICATE OF CORRECTION

PATENT NO : 5,996,989

DATED : December 7, 1999

INVENTOR(S) : D. P. Cahill, et al.

It is certified that error appears in the above-identified patent and that said Letters Patent is hereby corrected as shown below:

| | |
|---|---|
| Col. 10, line 2 | Delete "first". |

Signed and Sealed this

Twenty-ninth Day of August, 2000

*Attest:*

*Attesting Officer*

Q. TODD DICKINSON

*Director of Patents and Trademarks*